United States Patent [19]

Capetti

[11] 4,018,376

[45] Apr. 19, 1977

[54] PROCESS FOR OBTAINING SKEINS OF WIRE ROD OF A WEIGHT WHICH IS A MULTIPLE OF THAT OF A WIREBAR

[75] Inventor: Raffaele Capetti, Turin, Italy

[73] Assignee: A. Tonolli & C. S.p.A., Milan, Italy

[22] Filed: June 13, 1975

[21] Appl. No.: 586,608

[52] U.S. Cl. ..... 228/158; 228/170; 228/173

[51] Int. Cl.² ..... B21B 15/00

[58] Field of Search ..... 228/235, 243, 158, 173, 228/170

[56] References Cited

UNITED STATES PATENTS 1,940,939 12/1933 Coryell ..... 228/158

*Primary Examiner*—James L. Jones, Jr.
*Assistant Examiner*—K. J. Ramsey
*Attorney, Agent, or Firm*—Stevens, Davis, Miller & Mosher

[57] ABSTRACT

A process for obtaining skeins of wire rod of indefinite length comprising butt welding under axial pressure two successive wirebars already rough shaped and having their ends cropped with shears or another device, and then hot rolling until the final required wire rod size is obtained.

4 Claims, 1 Drawing Figure

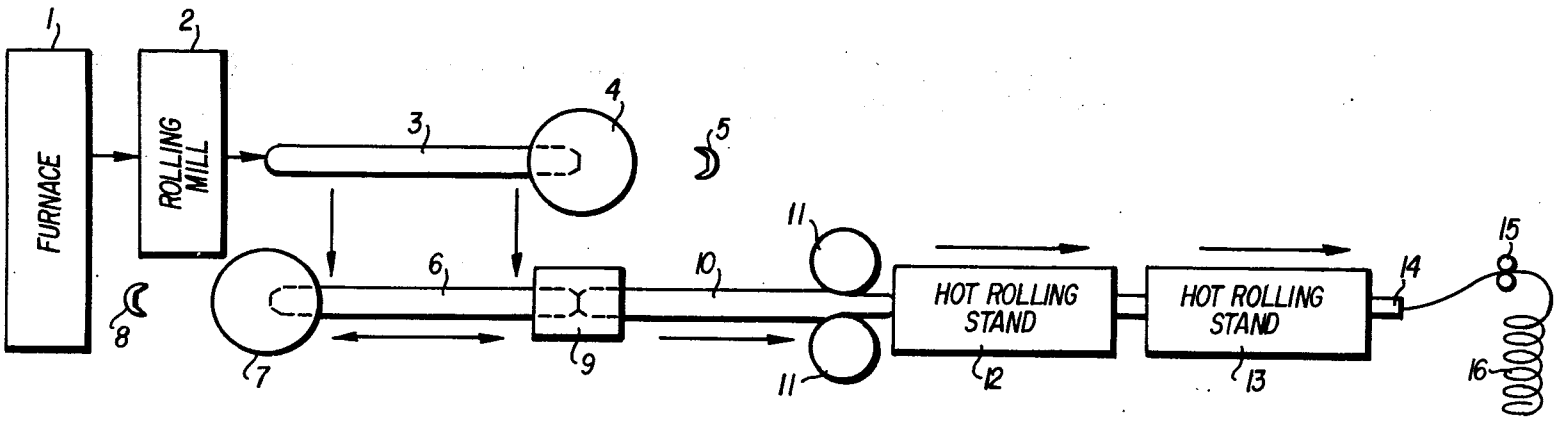
FURNACE
ROLLING MILL
HOT ROLLING STAND
HOT ROLLING STAND
1
2
3
4
5
6
7
8
9
10
11
11
12
13
14
15
16

PROCESS FOR OBTAINING SKEINS OF WIRE ROD OF A WEIGHT WHICH IS A MULTIPLE OF THAT OF A WIREBAR

This invention relates to a process, particularly a continuous process, for obtaining skeins of wire rod of a weight which is a multiple of that of a wirebar and of a diameter for example of 7 to 20 mm by butt welding two adjacent bars which have already been partially hot rolled, and which are then further hot rolled until the wire rod is finished. According to the method of operation used at the present time for producing copper wire rod from wirebars, skeins are obtained which correspond in weight to that of a wirebar, i.e. 90 – 135 kg. For their subsequent continuous drawing, the skeins have each to be welded and the relative ancillary operations have to be carried out, with considerable use of labor and corresponding increased costs.

By means of the present invention in which skeins are produced of a weight which is a multiple of that of a wirebar, the labor requirement and relative expenses may be drastically reduced, or even eliminated by producing skeins of wire rod of a weight corresponding to the feed required by the drawing machine for several hours of operation.

In particular, the welds obtained by the process according to the invention between one wirebar and the next possess superior metallurgical and mechanical properties, and under microscopic examination show grain dimensions and uniformity of distribution of oxygen and impurities which are entirely similar to those of the non-welded areas.

This uniformity of structure considerably limits the possibility of fracture during subsequent drawing or cold rolling to produce wire, strap or strip.

In the process according to the present invention, the weld between the two ends of two adjacent wirebars is made at rolling temperature and is preceded and followed by a certain number of hot rolling passes.

A further characteristic of the present invention is that the weld is made on a bar having a cross-section which is already less than the original cross-section of the wirebar, for example a cross-section of 20 cm², so limiting the cropping discard and the energy necessary for welding. The main stages of the preferred cycle of operation according to the present invention are as follows:

1. A first wirebar is subjected to roughing by hot rolling (three–eight passes).
2. The final end of the first bar is hot cropped with shears.
3. A second wirebar is subjected to roughing as under point 1.
4. The initial end of the second bar is cropped as under point 2.
5. The initial end of the second bar is placed against the final end of the first bar, which in the meantime has passed through the rolls of the subsequent rolling pass.
6. The two adjacent ends are butt welded under pressure (by an electric or flame welder).

7. Any welded material which projects beyond the contour of the welded bar is trimmed by hot removal of swaff.
8. Rolling is continued until the final required wire rod size is obtained.
9. Operations (1) to (8) are repeated then each wirebar leaves the roughing mill, so making it possible to weld two or more wirebars together during rolling.
10. The coil with a weight which is a multiple of the initial wirebar is wound. Uninterrupted rolling and electric coil winding may then take place, with the wire rod cut into coils of the required weight.

The single FIGURE is a block diagram of a typical preferred arrangement of the apparatus for performing the process of the present invention. The wirebars, such as wirebar 3, are fed one by one from a preheating furnace 1 to a three high hot roughing rolling mill 2 or trio mill, which reduces the wirebars to substantially the same size and shape. The hot rolled wirebar 3 leaving mill 2 is croppsed at one end by a crop shear 4 and transferred, on a transfer table not shown, to a crop shear 7 where it is cropped at the other end. The discarded ends of the wirebar are indicated with reference numerals 5 and 8. Thereafter, the one end of the hot wirebar now referenced as 6 is grasped and compressed by a butt welder machine 9 against the other end of a preceding wirebar indicated at 10. The two bars 6, 10 are axially aligned, hot butt welded and then deburred by a deburring device not shown, but which may be incorporated in the machine 9.

The hot rolled wirebar 10, made continuous by welding each bar to a previous one, is passed through an intermediate hot rolling stand 11, a prefinishing hot rolling stand 12, and a finishing hot rolling stand 13. These stands are used to reduce progressively the section of the continuous bar 10 to fixed final dimensions. The continuous bar is then passed through a cooling unit 14 and then wound in continuous rod skeins by a device 15 well known in the art.

What I claim is:

1. A continuous process for obtaining a copper skein from wirebars, comprising the ordered steps of:

a. preheating each wirebar to a normal hot rolling temperature;
b. continuously rough rolling the wirebars at the hot rolling temperature to reduce each wirebar to substantially identical size and shape;
c. cropping first and second ends of each wirebar;
d. butt welding at the hot rolling temperature the first end of one wirebar to the second end of another wirebar while pressing these two ends together;
e. continuously hot rolling the welded wirebars to a required size and length to finish the welded wirebars; and
f. winding the finished welded wirebars into a skein having a weight which is a multiple of the weight of a wirebar.

2. A process according to claim 1 further comprising, before the step (e) of continuously hot rolling, trimming any welded material which projects beyond the butt welded ends of the wirebars.

3. A process according to claim 2 wherein the wirebars are rough rolled to a cross-section of 20 cm².

4. A process according to claim 2 wherein the welded material is trimmed while the material is hot.

* * * * *